US005918553A

United States Patent [19]

Hellwig et al.

[11] Patent Number: 5,918,553

[45] Date of Patent: Jul. 6, 1999

[54] ADJUSTABLE HEIGHT TABLES

[75] Inventors: John Hellwig, Toronto; Steve Verbeek, Aurora; Lorie Marangoni, Weston; Genadij Makarewicz, Brampton, all of Canada

[73] Assignee: Teknion Furniture Systems, Canada

[21] Appl. No.: 08/844,070

[22] Filed: Apr. 28, 1997

[51] Int. Cl.[6] ..... A47B 9/00

[52] U.S. Cl. ..... 108/147.19; 108/156

[58] Field of Search ..... 108/147.19, 147.21, 108/154, 156, 158, 157.1, 158.11, 144.11, 116, 138, 148, 190, 155; 248/188.5

[56] References Cited

U.S. PATENT DOCUMENTS

| | | | |
|---|---|---|---|
| 1,631,513 | 6/1927 | Berry | 248/188.5 X |
| 2,622,353 | 12/1952 | Mendelson | 108/130 X |
| 2,794,612 | 6/1957 | Clifton | 248/188.5 X |
| 3,261,584 | 7/1966 | Miller | 108/156 X |
| 4,757,769 | 7/1988 | Suttles | 108/190 |
| 4,966,341 | 10/1990 | Borsani | 248/188.5 X |
| 5,083,806 | 1/1992 | Brown | 248/188.5 X |

FOREIGN PATENT DOCUMENTS

| | | | |
|---|---|---|---|
| 1094825 | 5/1955 | France | 108/156 |

*Primary Examiner*—Peter M. Cuomo
*Assistant Examiner*—Janet M. Wilkens

[57] ABSTRACT

A height adjustable work table comprises a work surface and at least three adjustable leg arrangements supporting said work surface. Each leg arrangement comprises a curved leg supported in a leg bracket attached beneath the work surface. Each leg bracket is an open channel having predetermined support positions for engaging the curved leg with fasteners for releasably securing the leg in any of the support positions.

12 Claims, 7 Drawing Sheets

FIG.1.
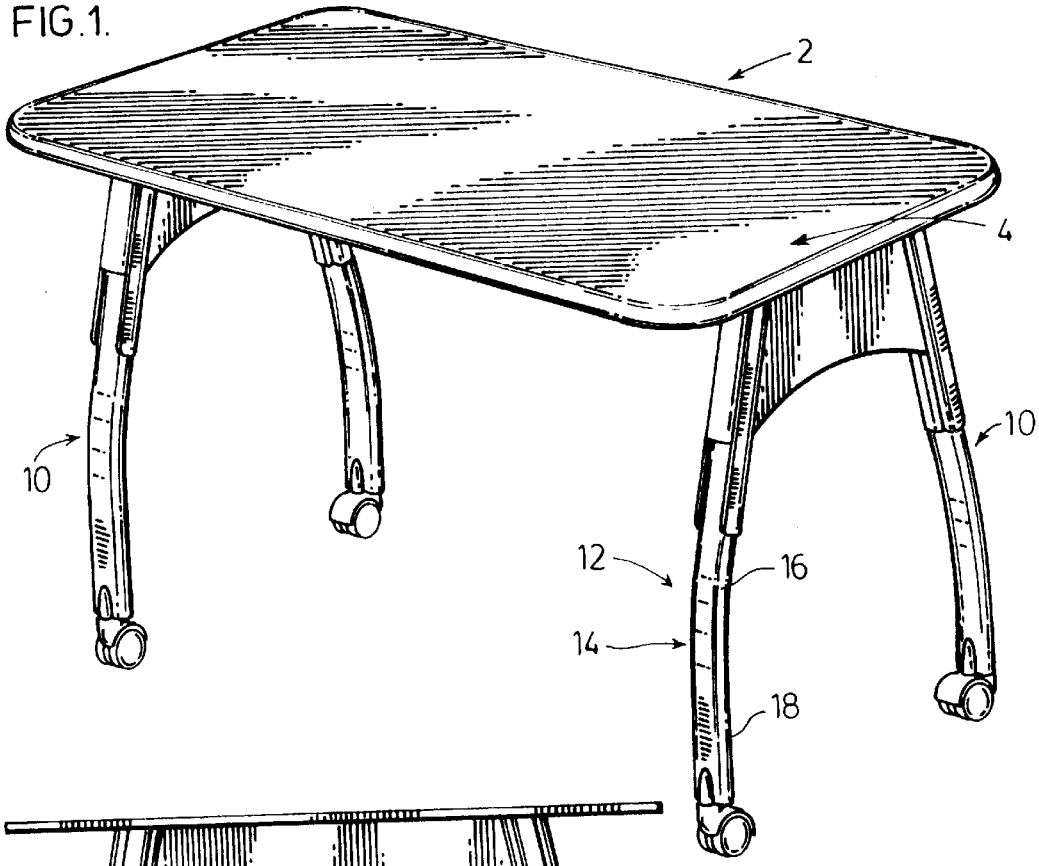
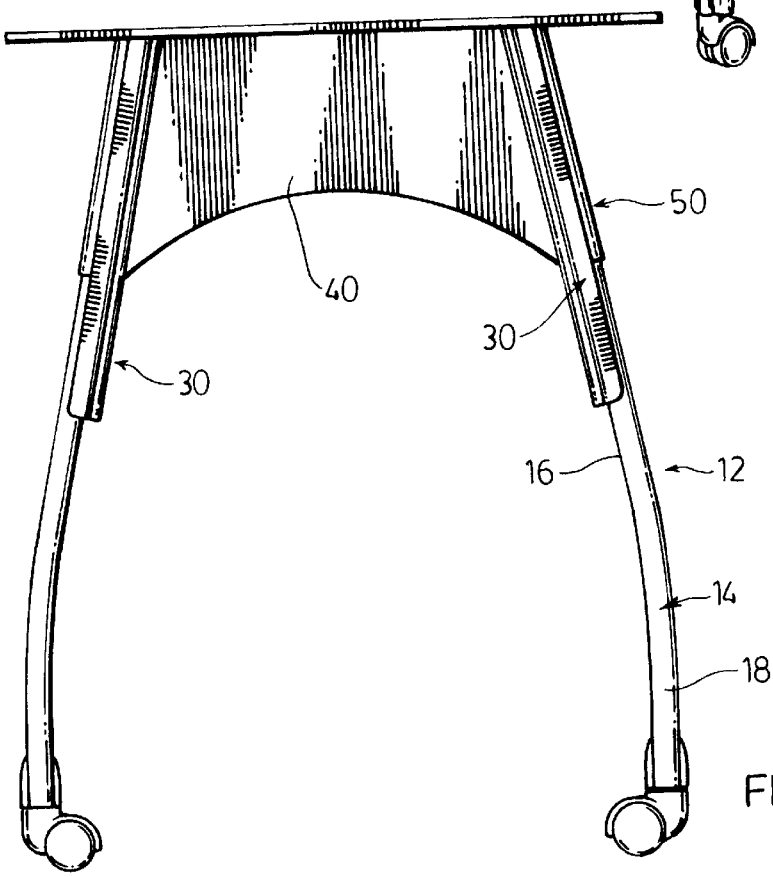
FIG.2.

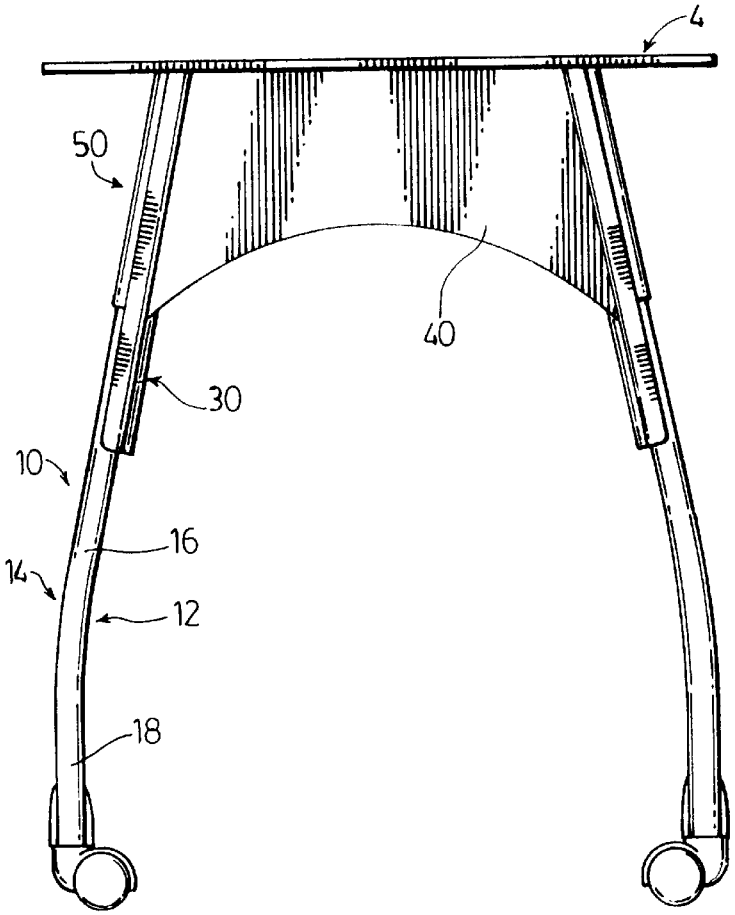
FIG. 3.
FIG. 4.
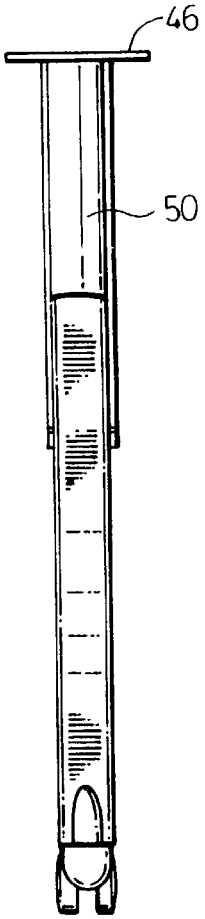
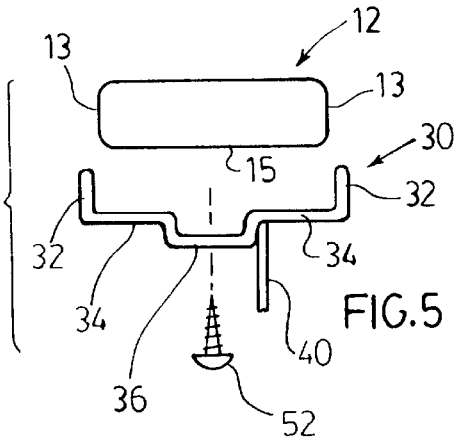
FIG. 5

ADJUSTABLE HEIGHT TABLES

FIELD OF THE INVENTION

The present invention relates to adjustable height tables and in particular, relates to adjustable height tables for office desks, work tables and conference tables.

BACKGROUND OF THE INVENTION

There are many examples of height adjustable tables for use in association with a work station. Computer stations are, perhaps, the best examples of work surfaces which are height-adjustable and can include either a mechanical counter-balancing arrangement, electrical drive arrangements or hydraulic arrangements for controlling the height of the work surface. There are also many telescopic legs for providing variable heights. The present invention provides a simple mechanical arrangement for varying the height of a work surface, such as a table or mobile table, which is relatively inexpensive to use, and provides increased stability as the height of the table increases.

SUMMARY OF THE INVENTION

A height adjustable work table, according to the present invention, comprises a work surface and at least three adjustable leg arrangements supporting the work surface. Each leg arrangement comprises a curve leg supported in the leg bracket attached beneath the work surface. The leg bracket is an open channel having predetermined support positions for engaging the curved leg with means for releasably securing said leg in any of the support positions.

According to an aspect of the invention, the curved leg is angled outwardly at the top thereof and is integral with a generally vertical lower section which terminates within the downward projection of the work surface.

According to a further aspect of the invention, each leg arrangement increases the support base as the height of the table is increased.

BRIEF DESCRIPTION OF THE DRAWINGS

Preferred embodiments of the invention are shown in the drawings, wherein:

FIG. 1 is a perspective view of a height-adjustable table having two opposed leg pairs;

FIG. 2 is perspective in view of the table in FIG. 1;

FIG. 3 is an inside view of the table of FIG. 2;

FIG. 4 is a side view of the paired leg arrangement;

FIG. 5 shows details of the securement of the curved leg to the channel bracket;

DETAILED DESCRIPTION OF THE PREFERRED EMBODIMENTS

Figure 7:
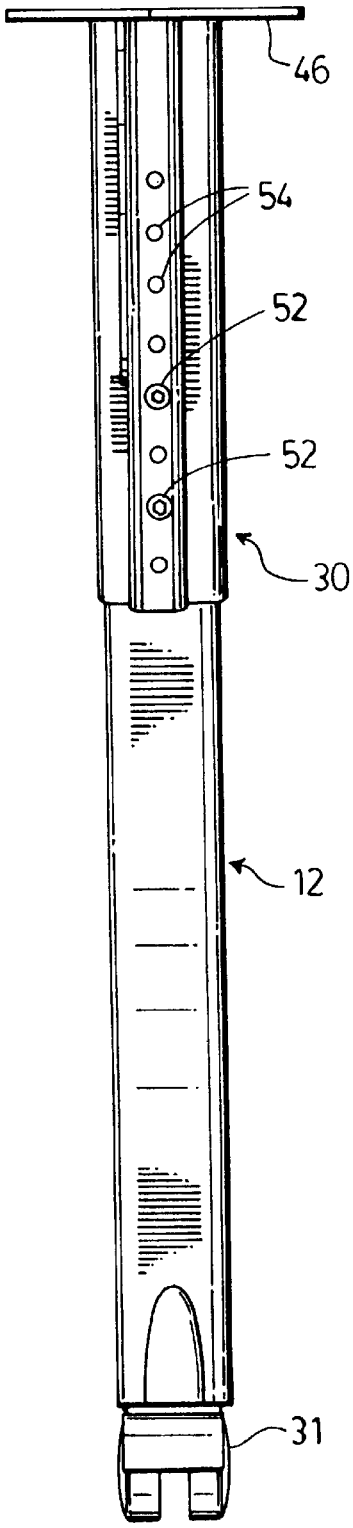
FIG. 7 is an end view of the leg of FIG. 6.

The height-adjustable table and the paired leg arrangement shown in FIGS. 1 through 4, define a height-adjustable table 2 having work surface 4. At opposite ends of the work surface and positioned slightly inwardly of the edges thereof, are two opposed paired leg arrangements 10. Each paired leg arrangement includes two curved legs 12 with each leg having a curved transition 14, approximately one foot above the base of the leg, which transition joins the generally straight upper section 16 and the generally straight lower section 18. The straight upper section is at an angle relative to vertical and it is received in a similarly angled channel-shaped leg support bracket 30. The generally straight upper leg section 16 allows movement of the leg within the channel-shaped leg support bracket and is securable to this bracket at a number of points, as will subsequently be described.

Figure 12:
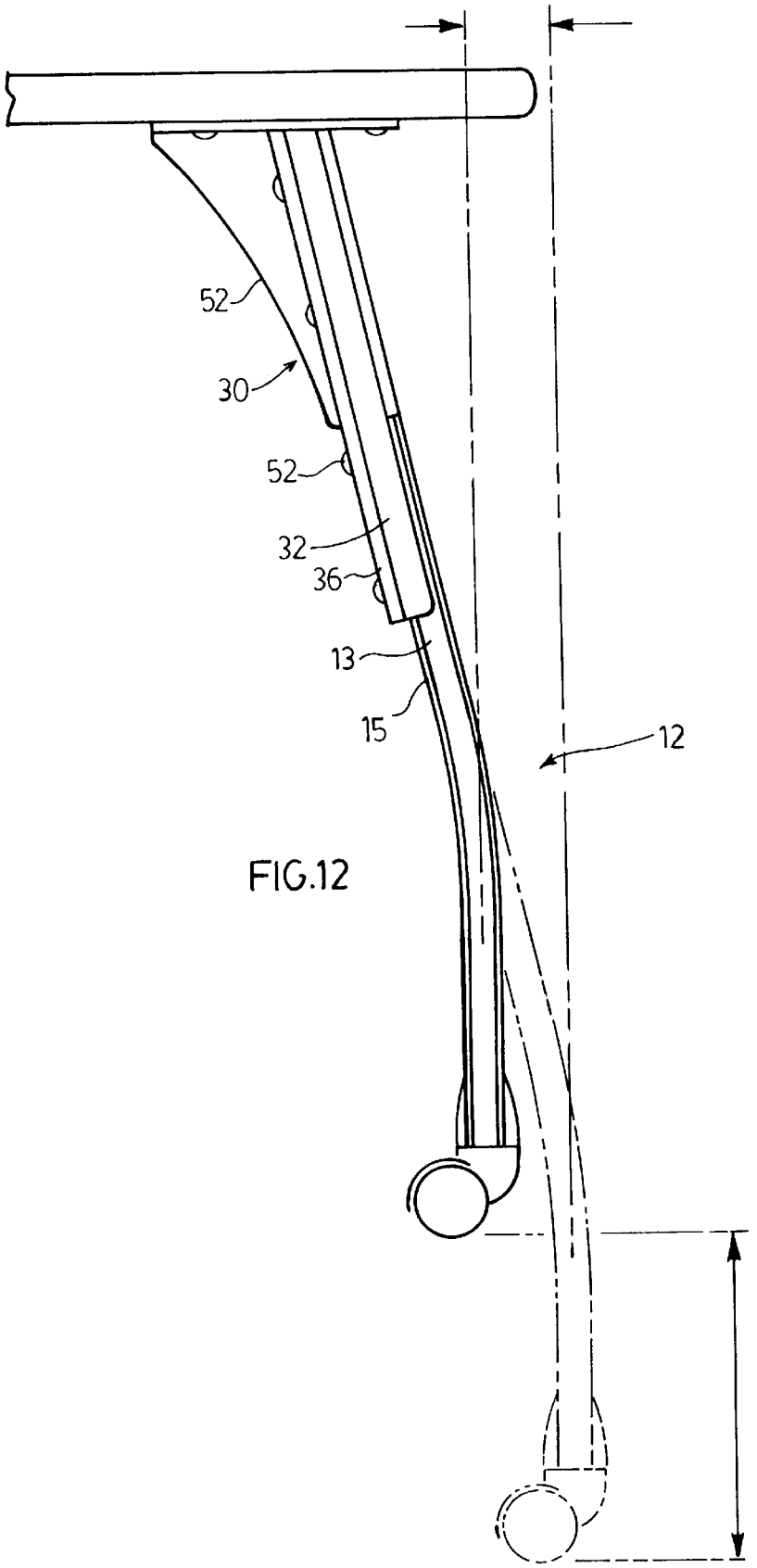
FIG. 12 is a side view of a single leg arrangement illustrating the increasing base as the height of the work surface increases.

As the leg is moved within the channel-shaped leg support bracket 30, the base of the table increases or decreases. For example, if the leg is moved downwardly the channel-shaped leg support bracket 30, the castor 31 associated with the leg is moved slightly outwardly, increasing the base of the table 2. This is desirable as the height of the table has increased, the base has increased and thus, the stability of the table has been appropriately adjusted. As shown in FIG. 12, the leg 12, even in the maximum height position, is located slightly inwardly of the edge of the work surface, such that the legs are still within the footprint of the work surface defined by the periphery of a downward projection of the work surface.

Each channel-shaped leg support bracket 30, as shown in FIGS. 5 and 12, has opposed sides 32 which support the side edges 13 of the leg 12 on the portion of the leg which overlaps with the channel-shaped leg support bracket. The leg 12 is secured to the channel 30 by means of screw fasteners 52 which pass through the rear of the channel-shaped leg support bracket and engage the leg 12. The actual shape of the channel 30 includes inwardly directed surfaces 34 which engage the back surface 15 of the leg with a further strengthening channel or differing recess 36 which extends inwardly of surfaces 34. This stiffens the channel-shaped leg support bracket.

Figure 11:
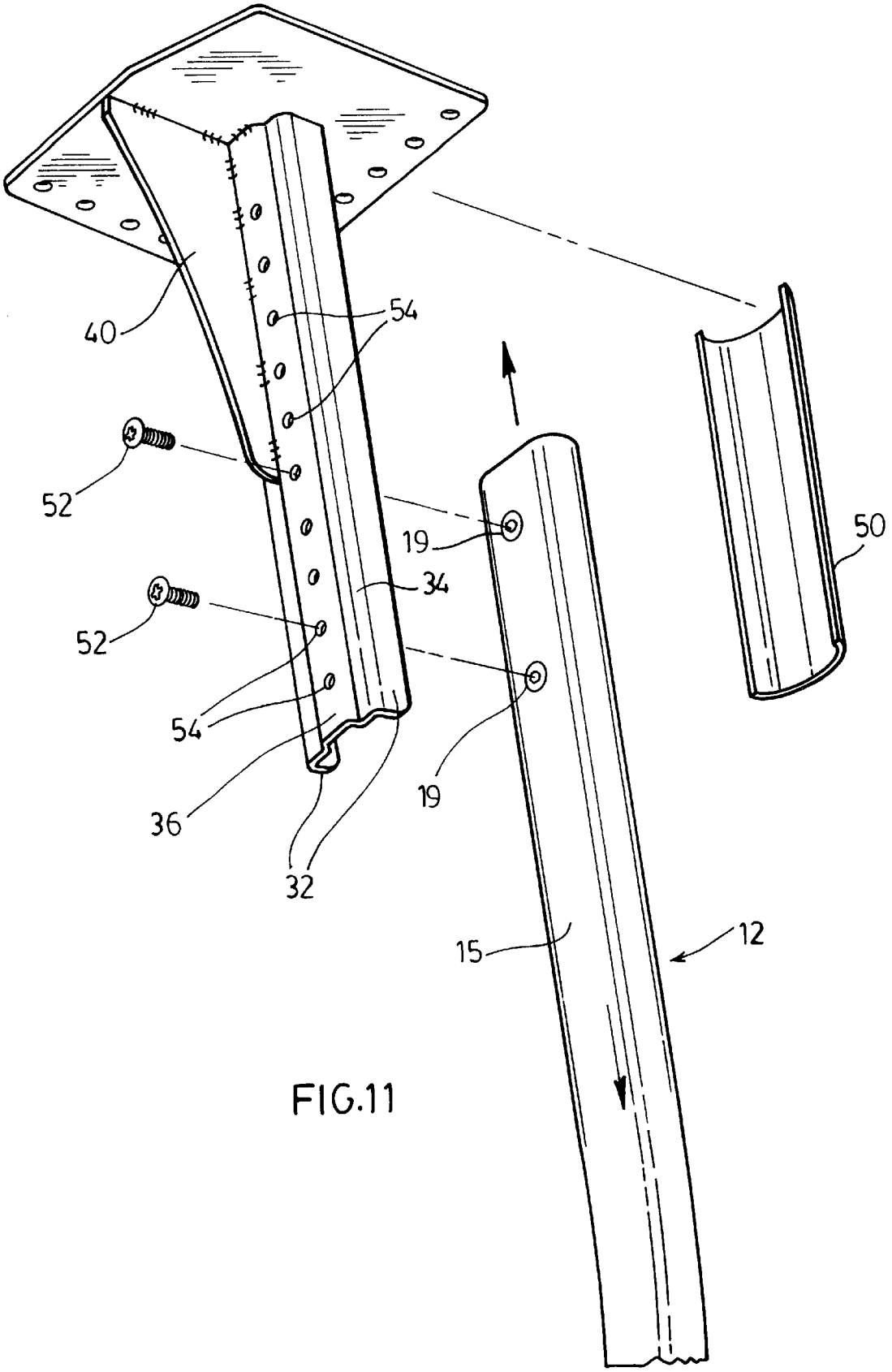
FIG. 11 is a partial perspective view of the single leg arrangement.

As shown in FIGS. 7 and 11, the leg 12 is secured to the leg support bracket 30 at a number of different positions. The back surface 15 of the leg has ports 19 provided therein for cooperation with fasteners 52. These fasteners cooperate with a series of ports 54 provided in the strengthening channel 36. The channel-shaped leg support bracket 30 has a series of ports 54 for adjusting the height in fixed increments.

As can be appreciated from FIGS. 11 and 12, there may be a gap at the top of the channel-shaped leg support bracket 30, if the legs of the table 2 are above the minimum position. To provide a more pleasing appearance a cover 50 provides a finished extension for the leg support bracket 30 that conceals what would otherwise be the exposed channel 30 above the leg. The cover 50 is open on the back side and telescopes on the leg 12. The cover 50 is adjusted prior to final securement of the leg to the bracket 30 and the final securement of the leg locks the cover 50 in place.

Figure 6:
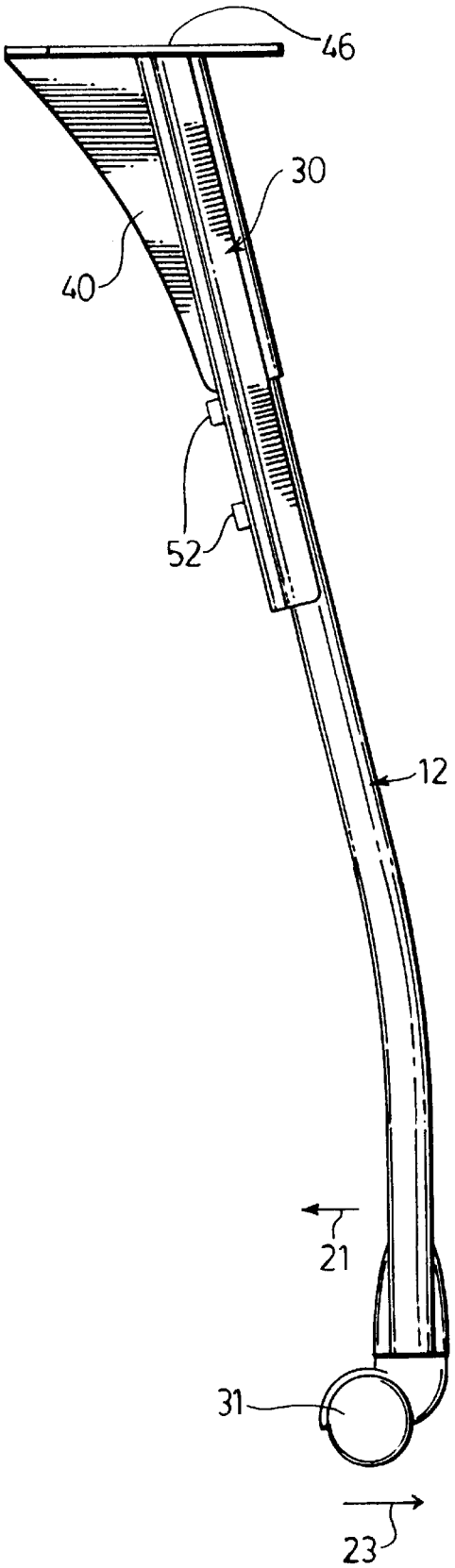
FIG. 6 is a side view of a single leg arrangement.
Figure 8:
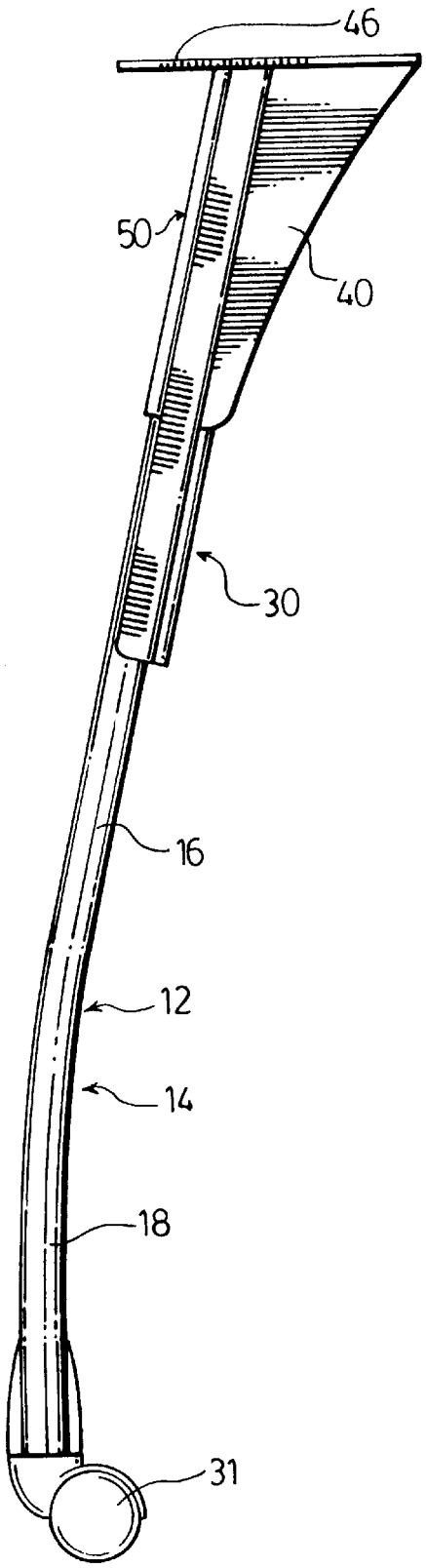
FIG. 8 is a further side view of the single leg arrangement.
Figure 9:
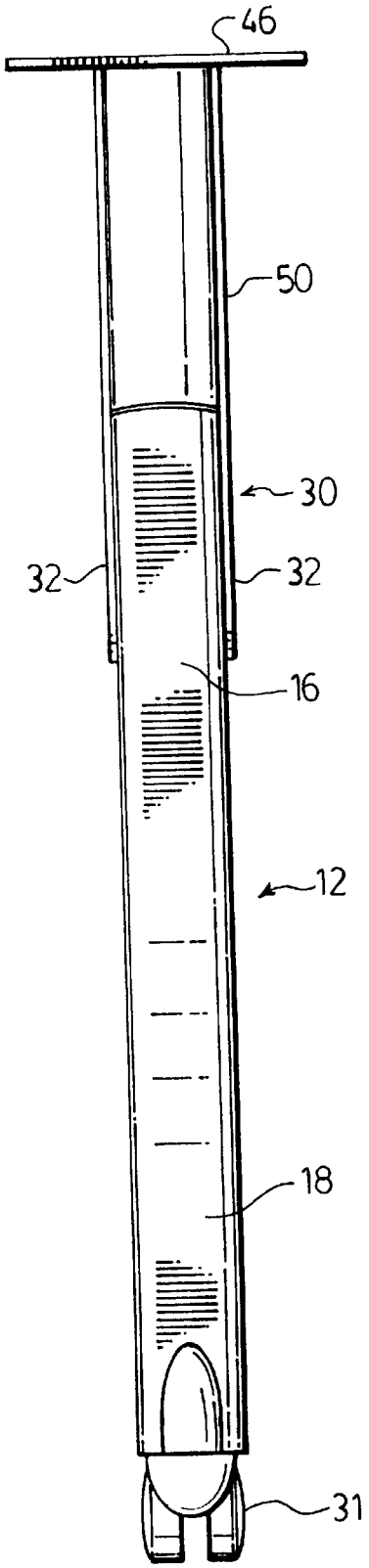
FIG. 9 is a front view of the single leg arrangement.

The side view of the single leg embodiment of FIG. 6 and the exploded view of FIG. 11 illustrate securement of the leg 12 to the channel-shaped leg support bracket 30 by fasteners 52. If the leg is released from the channel 30 and adjusted to provide an increase in the height of the table, the leg moves slightly outwardly as indicated by arrow 23 (see FIG. 12). This increases the base of the table and the stability thereof. If the height of the table is decreased, the bottom of the leg moves slightly inwardly as indicated by arrow 21.

The curved leg allows the leg support bracket 30 to be near the edge of the work surface with the leg angled outwardly. The curved transition 14 of the leg then joins with a vertical segment to maintain the base of the leg within the footprint of the work surface.

The single leg embodiment of FIGS. 6 through 12 includes a connecting strut or gusset 40 which is secured to the back of the channel-shaped leg support bracket 30 and is also fastened to the work surface support bracket 46 as shown in the preferred embodiment, the gusset 40 is a plate member. In the case of the paired leg arrangement 10 of FIGS. 1 through 4, the connecting strut or gusset 40 is continuous between the two channel-shaped leg support brackets. The connecting strut or gusset 40 includes an arched lower surface.

The embodiment, as shown in FIG. 1, illustrates a horizontal work surface 4, however, if desired, the rear legs of the table may be secured with a slightly different position increasing the height of the rear edge of the table, relative to the front edge of the table. This then defines an angled work surface which may be desirable for drafting or other applications. It can also be appreciated that the table could be angled upwardly or downwardly from end to end, if desired, by the appropriate setting of the legs 12.

Figure 10:
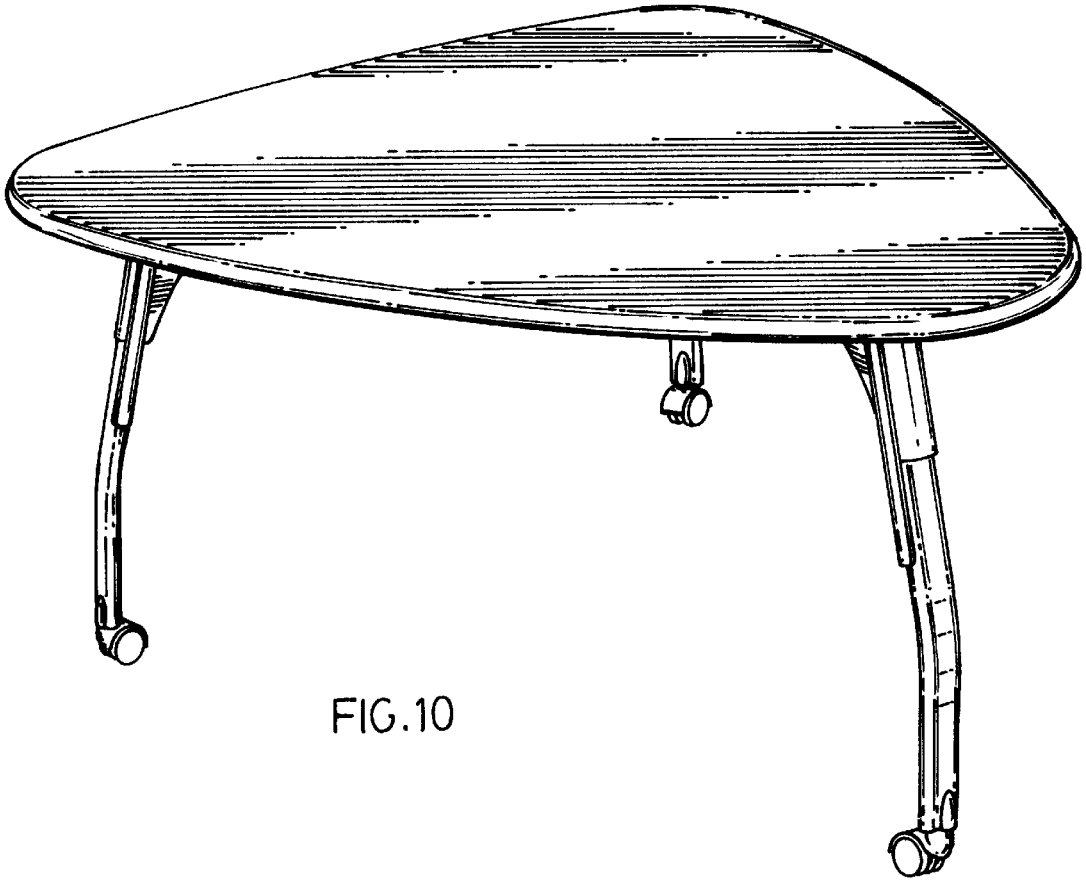
FIG. 10 shows the single leg arrangement secured to a generally triangular conference table.

The single leg design of FIGS. 6 through 9 is particularly advantageous with respect to tables which do not have a rectangular top surface. For example, the table as shown in FIG. 10, has three separate legs, each of which is disposed at a different angle, relative to the work surface.

The present invention provides a convenient cost effective structure for allowing the height of a table to be increased or decreased. It uses a simple mechanical design and it also allows for adjustment of the size of the base as the height of the table increases. The curved lower section of the leg also allows the table to generally stay within the footprint of the work surface and is unobtrusive. Also this design allows the support bracket atop the leg to be placed inwardly of the edge of the table reducing the likelihood of striking it during use.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A height adjustable work table comprising a work table surface and at least three adjustable leg arrangements supporting said work table surface, each leg arrangement comprising a curved leg supported in a leg bracket attached to the work table surface on a bottom surface thereof, and wherein each leg bracket is an open channel having a series of predetermined support positions for engaging the curved leg with means for releasably securing said leg in any of said support positions, said open channel of each leg bracket includes in a base of said channel a longitudinally extending stiffening recess.

2. A height adjustable work table as claimed in claim 1 wherein each leg bracket is outwardly angled beneath said work table surface and each curved leg has an upper section which is outwardly angled and is joined with a generally vertical lower section.

3. A height adjustable work table as claimed in claim 2 wherein each leg arrangement increases the spacing between said legs as the height of the table is increased.

4. A height adjustable table as claimed in claim 1 wherein each leg has a bent tube body portion.

5. A height adjustable table as claimed in claim 1 wherein said open channel of each leg bracket projects outwardly and downwardly from said work table surface and is positioned near the periphery of the work table surface.

6. A height adjustable table as claimed in claim 5 wherein said series of predetermined support positions of each leg bracket is a series of ports spaced in the length of said stiffening recess and each leg includes securing ports appropriately spaced for alignment with said series of ports.

7. A height adjustable table as claimed in claim 5 wherein each leg bracket at an upper end thereof includes a top plate sized to distribute forces between said leg and said work table surface and said open channel of each leg bracket is attached to said respective top plate and a reinforcing strut further connects said top plate and said open channel.

8. A height adjustable table as claimed in claim 1 wherein each leg bracket at an upper end thereof includes a top plate which forms part of the securement with a bottom portion of said work table surface, each top plate having a series of holes therein which receive fasteners used to secure said top plate to said work table surface.

9. A height adjustable work table as claimed in claim 1 wherein said table has two pairs of legs and each pair of legs has the leg brackets thereof integral with a common strut joining the upper ends of each leg bracket.

10. A height adjustable work table as claimed in claim 9 wherein each common strut is a plate member having an arched lower surface extending between said open channels.

11. A height adjustable work table comprising a work table surface and at least three adjustable leg arrangements supporting said work table surface, each leg arrangement comprising a curved leg supported in a leg bracket attached to the work table surface on a bottom surface thereof, and wherein each leg bracket is an open channel having a series of predetermined support positions for engaging the curved leg with means for releasably securing said leg in any of said support positions, and each leg arrangement including a cover member closing said open channel between an upper surface of said leg and said work surface.

12. A height adjustable table as claimed in claim 11, wherein said cover of each leg arrangement is maintained in place by the securement of said leg to said leg bracket.

* * * * *